US006072398A

United States Patent [19]

Hayes et al.

[11] Patent Number: 6,072,398

[45] Date of Patent: Jun. 6, 2000

[54] AUTOMATIC GAS DETECTION SYSTEM

[76] Inventors: James Hayes; Corrinna Hayes, both of 12 Galassi Ct., Jackson, N.J. 08527

[21] Appl. No.: 09/294,877

[22] Filed: Apr. 20, 1999

[51] Int. Cl.[7] ..... G08B 17/10

[52] U.S. Cl. ..... 340/632; 340/407.1; 340/438; 454/75; 454/128; 180/271

[58] Field of Search ..... 340/632, 438, 340/407.1, 575, 576; 454/75, 128; 180/271

[56] References Cited

U.S. PATENT DOCUMENTS

| | | | |
|---|---|---|---|
| 3,418,914 | 12/1968 | Finkin | 454/75 |
| 3,686,655 | 8/1972 | Kasahara | 340/384 |
| 3,786,462 | 1/1974 | Hayden | 340/52 |
| 3,789,231 | 1/1974 | Hayden | 340/632 X |
| 4,485,375 | 11/1984 | Hershberger | 340/576 |
| 4,912,338 | 3/1990 | Bingham | 307/9.1 |
| 5,066,466 | 11/1991 | Holter et al. | 422/98 |
| 5,333,703 | 8/1994 | James et al. | 340/438 X |
| 5,488,353 | 1/1996 | Kawakami et al. | 340/576 |
| 5,739,756 | 4/1998 | Margulies | 340/632 |
| 5,764,150 | 6/1998 | Fleury et al. | 340/632 |
| 5,765,116 | 6/1998 | Wilson-Jones et al. | 340/439 |
| 5,835,028 | 11/1998 | Bender et al. | 340/937 |
| 5,969,616 | 10/1999 | Tschoi | 340/576 |

*Primary Examiner*—Daniel J. Wu
*Assistant Examiner*—Sihong Huang
*Attorney, Agent, or Firm*—Henderson & Sturm LLP

[57] ABSTRACT

An automatic gas detection system 10 for vehicles 100 wherein a carbon monoxide sensor 20 is disposed within the passenger compartment 101 of the vehicle 100 and the output of the sensor 20 is fed to a microprocessor control member 50 that will activate a multi-function steering wheel mounted alarm member 30 and lower the power windows 102 a predetermined amount via a power window reversible motor 40 and relay element 41 in response to a high concentration of carbon monoxide being detected by the sensor 20.

3 Claims, 1 Drawing Sheet

AUTOMATIC GAS DETECTION SYSTEM

BACKGROUND OF THE INVENTION

1. Field of the Invention

The present invention relates to the field of carbon monoxide sensors in general and in particular to a carbon monoxide detection system that automatically vents the passenger compartment of a vehicle.

2. Description of Related Art

As can be seen by reference to the following U.S. Pat. Nos. 3,786,462; 3,686,655; 4,912,338; 5,764,150; and, 5,066,466, the prior art is replete with myriad and diverse carbon monoxide detection systems for vehicles.

While all of the aforementioned prior art constructions are more than adequate for the basic purpose and function for which they have been specifically designed, they are uniformly deficient with respect to their failure to provide a simple, efficient, and practical carbon monoxide monitoring system for vehicles that will not only automatically notify the occupants of the vehicle of the existence of a dangerous condition within the passenger compartment but also immediately introduce fresh air into the passenger compartment.

As most vehicle operators are aware, one of the most dangerous aspects of long distance driving occurs when carbon monoxide builds up within the passenger compartment during cold and/or inclement weather that forces the vehicle operator to keep the vehicle windows in the closed position.

As a consequence of the foregoing situation, there has existed a longstanding need for a new and improved type of automatic gas detection system for vehicles which will immediately admit fresh air into the passenger compartment when dangerous gas levels are present; and, the provision of such a system is the stated objective of the present invention.

BRIEF SUMMARY OF THE INVENTION

Briefly stated, the automatic gas detection system that forms the basis of the present invention comprises in general a detection unit operatively connected to an alarm unit and a power window unit wherein a control unit will activate the alarm unit and the power window unit in response to the output of the gas detection unit.

As will be explained in greater detail further on in the specification, the sensor unit is disposed within the passenger compartment of a vehicle and associated with the control unit such that when a predetermined level of carbon monoxide is detected within the passenger compartment, a steering wheel mounted multi-function alarm member will be activated and the vehicle power windows will be simultaneously lowered a predetermined amount both to purge the passenger compartment of the noxious gases as well as to limit the driver's exposure to inclement weather conditions that might precipitate an undesirable reaction on behalf of the vehicle operator.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
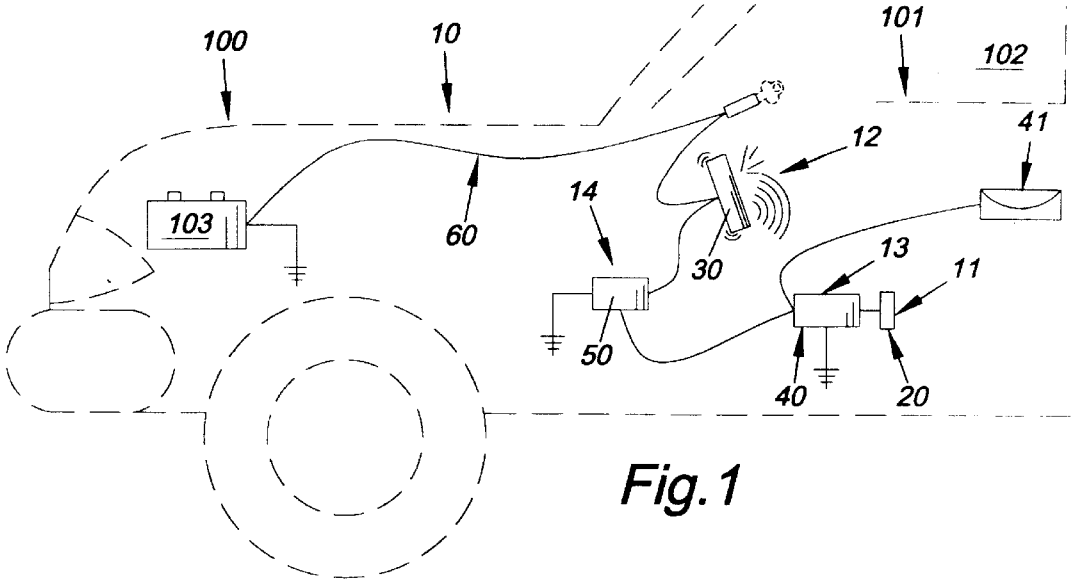
FIG. 1 is a schematic representation of the components of the gas detection system deployed in a vehicle; and, FIG. 2 is a flow chart showing the mode of operation of the gas detection system.

As can be seen by reference to the drawings, and in particular to FIG. 1, the automatic gas detection system that forms the basis of the present invention is designated generally by the reference number 10. The system 10 comprises in general a gas detection unit 11, an alarm unit 12, a power window unit 13, and a control unit 14. These units will now be described in seriatim fashion.

As shown in FIG. 1, the gas detection unit 11 comprises a conventional carbon monoxide sensor 20 disposed within the passenger compartment 101 of a motor vehicle 100. The alarm unit 12 comprises a steering wheel mounted alarm member 30 having both audible, visual, and tactile alarm features. The power window unit 13 comprises a reversible power window motor 40 provided with a power window relay element 41 that will govern the direction that the power window motor 40 will drive the power windows 102; and, the control unit 14 comprises a microprocessor control member 50 that is operatively connected to the other units by conventional electrical wiring 60.

In addition, the gas detection system 10 is coupled to the vehicle battery 103; wherein, the operation of the vehicle ignition switch 104 will energize the detection system 10 when in the off-position in a well-recognized fashion.

As was mentioned previously, the steering wheel mounted alarm member 30 has audible, visual and tactile alarm features due to the fact that all three alarm features are absolutely crucial to the proper operation of the system 10.

While most people would consider either one alarm feature or a combination of any two alarm features to be more than adequate, it is to be understood that the presence of all three alarm functions is considered to be necessary to make this system as fail safe as possible.

To that end, audible alarm functions can be drowned out by the high radio volumes preferred by many drivers. The visual alarm functions which includes the flashing light variety, can be washed out by bright sunlight and/or glare conditions and the vibratory tactile alarm feature can be masked by rough road conditions.

While it is unlikely that all three of the aforementioned counterbalancing conditions will occur simultaneously to override the effectiveness of the multi-function alarm unit 12 this system does not solely rely on the alarm unit 12 to warn the vehicle operator to take corrective action.

To that end, audible alarm functions can be drowned out by the high radio volumes preferred by many drivers. The visual alarm functions which includes the flashing light variety, can be washed out by bright sunlight and/or glare conditions and the vibrators tactile alarm feature can be masked by rough road conditions.

While it is unlikely that all three of the aforementioned counterbalancing conditions will occur simultaneously to override the effectiveness of the multi-function alarm unit 12, this system does not solely rely on the alarm unit 12 to warn the vehicle operator to take corrective action.

Still referring to FIG. 1, it can be seen that the control unit 14 is not only connected to the carbon monoxide sensor 11 and the multi-function alarm member 30 to activate the alarm member 30 in response to high concentration of carbon monoxide within the passenger compartment 101 but the microprocessor control unit 50 is also operatively connected to the reversible power window motor 40 and directional relay 41 to automatically take corrective action when the carbon monoxide sensor 20 registers high concentrations of carbon monoxide gas within the vehicle passenger compartment 101.

Figure 2:
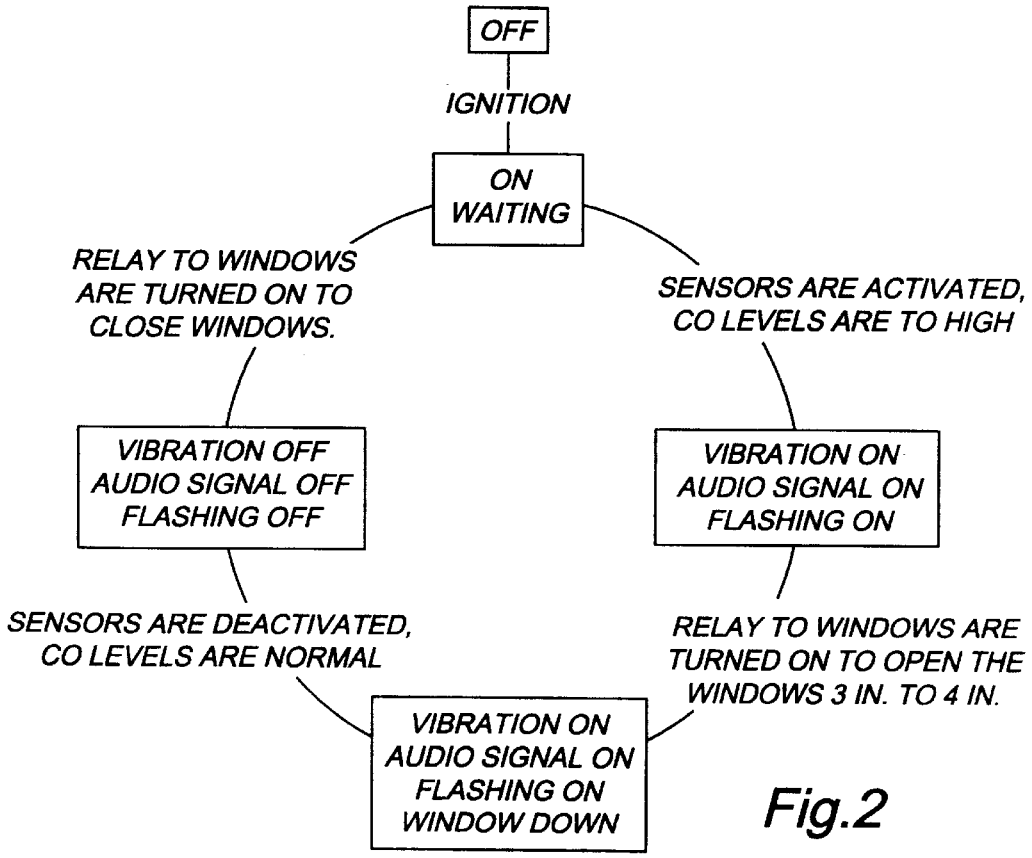

Turning now to FIGS. 1 and 2, it can be seen that the automatic gas detection system operates in the following manner. Once the vehicle operator turns the ignition switch to the "on" position, the system 10 will be energized by the vehicle battery 103 to allow the carbon monoxide sensor 20 to monitor the levels of carbon monoxide gas present in the passenger compartment 101.

The sensor 20 relays data to the microprocessor control member 50 which will respond to preset data values from the sensor 20 to activate both the multi-function steering wheel mounted alarm member 30 and to energize the reversible power window motor 40 and relay 41 to retract the power windows 102 for a predetermined amount of time so that the windows 102 will be lowered approximately three to four inches in response to the command of the microprocessor control member 50.

This relatively slight retraction of the power windows 102 is not a mere matter of choice, but is specifically designed to accomplish a number of important reasons. The first of which bring the immediate introduction of fresh air into the passenger compartment and the removal of a like quantity of foul air; and, the second of which being to provide the vehicle operator with a tactile, audible, and visual signal provided by a rush of fresh air into the vehicle compartments that cannot be ignored even if the multi-function alarm member 30 has been rendered inoperative.

In addition, given the fact that high levels of carbon monoxide gas within the passenger compartment 101 can easily cause the vehicle operator to become befuddled; it is imperative that the power windows 102 are not completely lowered at once which would not only startle the vehicle operator in their diminished mental capacity; but, which could also cause rain, sleet, or snow to be suddenly introduced into the vehicle passenger compartment prompting a panicked reaction on the part of the vehicle operator when suddenly exposed to these conditions.

As a consequence of the foregoing situation, it has been determined that the three to four inch retraction of the power windows 102 is sufficient to purge the passenger compartment 101 without causing any sudden corrective actions to be undertaken on the part of the vehicle operator.

Still referring to FIGS. 1 and 2, it can be seen that the carbon monoxide sensor 20 is positioned at a fairly low level within the interior of the passenger compartment 101 to provide an early warning of the build up of dangerous levels of carbon monoxide; and, once the sensor 20 registers the fact that acceptable levels of carbon monoxide exist within the vehicle compartment 101 a signal will be sent to the microprocessor control member 50 to deactivate the multi-function alarm member 30 and trip the power window relay 41 to reverse the direction of the power window motor 40 to close the power windows once again.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. An automatic gas detection system for the passenger compartment of a vehicle provided with power windows which are connected to a vehicle battery by an ignition switch; wherein, the system consists of:

a gas detection unit including a carbon monoxide sensor mounted within the passenger compartment;

an alarm unit including a steering wheel mounted multi-function alarm member;

a power window unit including a reversible power window motor having a power window relay element; and, a control unit including a microprocessor control member operatively connected to the vehicle battery via the ignition switch and operatively associated with the alarm unit, the gas detection unit, and the power window unit for activating the alarm unit and the power window unit in response to the output of the gas detection unit; wherein, the multi-function alarm member is provided with visual, audible and tactile features; and the microprocessor control member will activate the power window relay element to drive the reversible power window motor in one direction to lower the power windows from the closed position in response to the carbon monoxide sensor detecting high concentrations of carbon monoxide within the vehicle passenger compartment; wherein, the maximum distance that the power windows are lowered is four inches.

2. The system as in claim 1; wherein, the microprocessor control member will activate the power window relay element to drive the reversible power window motor in another direction to raise the power windows to the closed position when the carbon monoxide sensor detects acceptable levels of carbon monoxide within the vehicle passenger compartment.

3. The system as in claim 1; wherein, the minimum distance that the power windows are lowered is three inches.

* * * * *